US006064351A

United States Patent [19]

Mandai et al.

[11] Patent Number: 6,064,351

[45] Date of Patent: May 16, 2000

[54] CHIP ANTENNA AND A METHOD FOR ADJUSTING FREQUENCY OF THE SAME

[75] Inventors: Harufumi Mandai, Takatsuki; Teruhisa Tsuru, Kameoka, both of Japan

[73] Assignee: Murata Manufacturing Co., Ltd., Japan

[21] Appl. No.: 09/034,416

[22] Filed: Mar. 4, 1998

[30] Foreign Application Priority Data

Mar. 5, 1997 [JP] Japan ..... 9-050521

[51] Int. Cl.[7] ..... H01Q 1/24; H01Q 1/36

[52] U.S. Cl. ..... 343/873; 343/895; 343/700 MS

[58] Field of Search ..... 343/873, 702, 343/700 MS, 895

[56] References Cited

U.S. PATENT DOCUMENTS 4,720,620 1/1988 Arima ..... 437/173
5,268,702 12/1993 Amano et al. ..... 343/846
5,541,610 7/1996 Imanishi et al. ..... 343/702
5,561,437 10/1996 Phillips et al. ..... 343/702
5,754,146 5/1998 Knowles et al. ..... 343/895

*Primary Examiner*—Don Wong
*Assistant Examiner*—James Clinger
*Attorney, Agent, or Firm*—Ostrolenk, Faber, Gerb & Soffen, LLP

[57] ABSTRACT

A chip antenna 10 is formed of a rectangular prism substrate 11 made of a dielectric material (relative magnetic permeability: approximately 6.1) essentially consisting of barium oxide, aluminum oxide, and silica. A conductor 12 is spirally wound within the substrate 11 in the longitudinal direction of the substrate 11. A power feeding terminal 13 is formed on a surface of the substrate 11 and is connected to one end of the conductor 12 in order to apply a voltage to the conductor 12. A trimming electrode 14 generally formed in the shape of a rectangle is formed on a surface of the substrate 11 and is connected to the other end of the conductor 12. With the above configuration, a capacitive coupling is generated between the trimming electrode 14 and a ground (not shown) of a mobile communication unit on which the chip antenna 10 is mounted, and between the trimming electrode 14 and the conductor 12.

5 Claims, 5 Drawing Sheets

CHIP ANTENNA AND A METHOD FOR ADJUSTING FREQUENCY OF THE SAME

BACKGROUND OF THE PRESENT INVENTION

1. Field of the Invention

The present invention relates to a chip antenna and a method for adjusting a frequency of the chip antenna. More particularly, the invention relates to a chip antenna used in mobile communication equipment for mobile communications and local area networks (LAN). The invention is also concerned with a method for for adjusting a frequency of the above type of chip antenna.

2. Related Art of the Present Invention

FIG. 10 is a side perspective view illustrating a conventional chip antenna. A chip antenna 50 is formed of a rectangular-prism insulator 51, a conductor 52, a magnetic member 53, and external connecting terminals 54*a* and 54*b*. The insulator 51 is formed by laminating insulating layers (not shown) made of an insulating powder, such as alumina or steatite. The conductor 52 is made of, for example, silver or silver-palladium, formed in the shape of a coil within the insulator 51. The magnetic member 53 is made of a magnetic powder, such as a ferrite powder, and is formed within the insulator 51 and the coil-like conductor 52. The external connecting terminals 54*a* and 54*b* are attached to leading ends (not shown) of the conductor 52 and burned after the insulator 51 is fired.

The above known type of chip antenna is miniaturized compared with a whip antenna, which is commonly used for mobile communications. Accordingly, this chip antenna is surface-mountable. The bandwidth of the chip antenna, on the other hand, is comparatively narrow. In the manufacturing process, therefore, a deviation of the resonant frequency from a predetermined value seriously reduces the gain of the chip antenna, thereby lowering the yield of the chip antenna.

SUMMARY OF THE INVENTION

Accordingly, in order to overcome the above problem, it is an object of the present invention to provide a chip antenna in which adjustments are easily made to ensure a predetermined resonant frequency, and also to provide a method for adjusting a frequency of the chip antenna.

The present invention provides a chip antenna comprising: a substrate made of at least one of dielectric material and a magnetic material; at least one conductor disposed at least one of within said substrate and on a surface of said substrate; at least one power feeding terminal disposed on a surface of said substrate and connected to one end of said conductor for applying a voltage to said conductor; and a trimming electrode disposed at least one of within said substrate and on a surface of said substrate and connected to the other end of said conductor.

Since a trimming electrode connected to the other end of a conductor is provided, a capacitive coupling is formed between the trimming electrode and each of the conductor and a ground of a mobile communication unit on which the chip antenna is mounted. Accordingly, by adjusting the area of the trimming electrode, the amount of the capacitive coupling can be adjustable, thereby making it possible to adjust the resonant frequency of the chip antenna. As a result, the resonant frequency is easily adjustable in the manufacturing process of the chip antenna, thereby improving the yield of the chip antenna.

The above described chip antenna may further comprise a resin layer covering said trimming electrode.

Since the trimming electrode is coated with a resin layer, the environment-resistance and characteristics are improved and further the reliability of the chip antenna is enhanced.

In the above described chip antenna, said substrate may be formed by laminating a plurality of layers together, the layers each having a major surface; and said trimming electrode may be disposed on one of the major surfaces of said layers.

In the above described chip antenna, said substrate may be formed by laminating a plurality of layers together, the layers each having a major surface and the substrate having a laminating direction normal to the major surface; and said conductor may be spiral shaped and having a spiral axis disposed perpendicular to the laminating direction of said substrate.

In the above described chip antenna, said conductor may be formed in a plane on one of a surface of the substrate in a meander shape.

The present invention further provides a method for adjusting a frequency of the above described chip antenna, comprising the steps of: changing an area of said trimming electrode.

In the above described method, the area of said trimming electrode may be changed by using a laser.

By adjusting the area of the trimming electrode connected to the other end of the conductor, the capacitive coupling can be adjustable, thereby making it possible to regulate the resonant frequency of the chip antenna. As a consequence, the resonant frequency is easily adjustable in the manufacturing process of the chip antenna, thereby enhancing the yield of the chip antenna.

BRIEF DESCRIPTION OF THE DRAWINGS

FIGS. 9(*b*) is a top view illustrating a comb-like shape as an example of a modification made to the trimming electrode.

FIGS. 9(*c*) is a top view illustrating a group-like shape as an example of a modification made to the trimming electrode.

DESCRIPTION OF PREFERRED EMBODIMENTS

Figure 1:
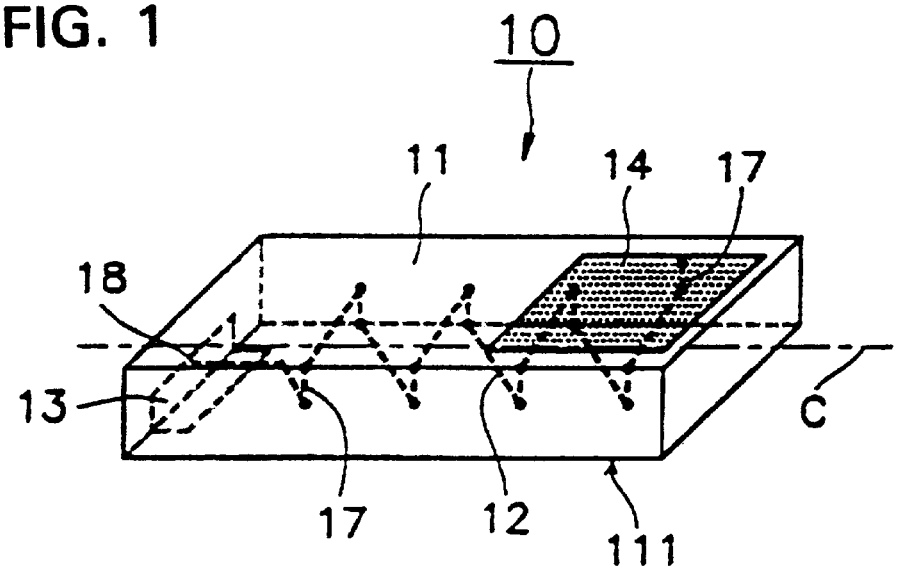
FIG. 1 is a perspective view illustrating a first embodiment of a chip antenna of the present invention.

Other features and advantages of the present invention will become apparent from the following description of preferred embodiments of the invention which refers to the accompanying drawings, wherein like reference numerals indicate like elements to avoid duplicative description.

Figure 2:
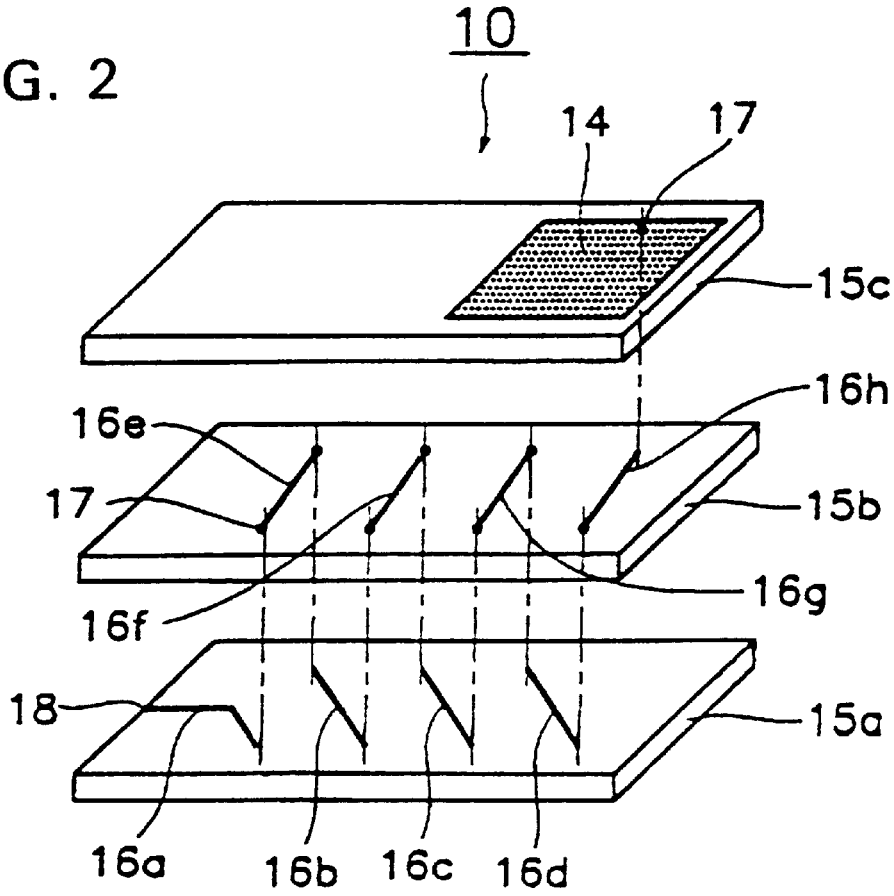
FIG. 2 is an exploded perspective view illustrating the chip antenna shown in FIG. 1.

FIGS. 1 and 2 are respectively a perspective view and an exploded perspective view illustrating a first embodiment of a chip antenna of the present invention. A chip antenna 10 is formed of a rectangular-prism substrate 11 having a mounting surface 111, a conductor 12, a power feeding terminal 13, and a trimming electrode 14 formed generally in the shape of a rectangle and provided on the surface of the substrate 11. The conductor 12 is spirally wound within the substrate 11, the winding axis C being positioned in the direction parallel to the mounting surface 111, i.e., in the longitudinal direction of the substrate 11. The power feeding terminal 13 is formed over surfaces of the substrate 11 in order to apply a voltage to the conductor 12. The conductor 12 is connected at one end to the power feeding terminal 13 and at the other end to the trimming electrode 14. With this configuration, a capacitive coupling is generated between the trimming electrode 14 and a ground (not shown) of a mobile communication unit on which the chip antenna 10 is mounted, and between the trimming electrode 14 and the conductor 12.

The substrate 11 is formed by laminating rectangular sheet layers 15*a* through 15*c* made of a dielectric material (relative magnetic permeability: approximately 6.1) essentially consisting of barium oxide, aluminum oxide, and silica. Conductor patterns 16*a* through 16*h* formed in a straight line or generally an L shape and made of copper or a copper alloy are provided on the surfaces of the sheet layers 15*a* and 15*b* by means such as printing, vapor-depositing, laminating, or plating. Formed on the sheet layer 15*c* by means such as printing, vapor-depositing, laminating, or plating is the trimming electrode 14 generally formed in a rectangle and made of copper or a copper alloy. Further, via-holes 17 are provided at predetermined positions (at both ends of each of the conductor patterns 16*e* through 16*g* and one end of the conductor pattern 16*h*) on the sheet layer 15*b* and at a predetermined position (the vicinity of one end of the trimming electrode 14) on the sheet layer 15*c*.

Then, the sheet layers 15*a* through 15*c* are laminated and sintered, and the conductor patterns 16*a* through 16*h* are connected through the via-holes 17, thereby forming the conductor 12 having a rectangular shape in winding cross section and spirally wound within the substrate 11 in the longitudinal direction of the substrate 11. Further, the trimming electrode 14 generally formed in a rectangle is formed on the surface of the substrate 11.

One end of the conductor 12 (one end of the conductor pattern 16*a*) is led to the surface of the substrate 11 so as to form a power supply section 18 and is connected to the power feeding terminal 13 which is provided over the surfaces of the substrate 11 to apply a voltage to the conductor 12. The other end of the conductor 12 (one end of the conductor pattern 16*h*) is connected to the trimming electrode 14 through the via-hole 17 within the substrate 11.

Figure 3:
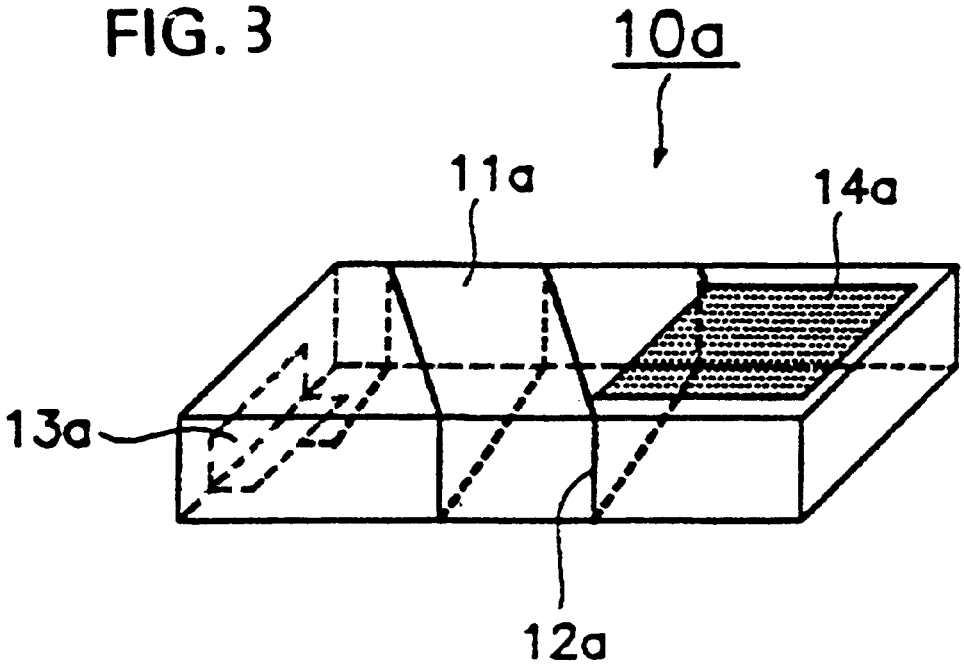
FIG. 3 is a perspective view illustrating an example of modifications made to the chip antenna shown in FIG. 1.
Figure 4:
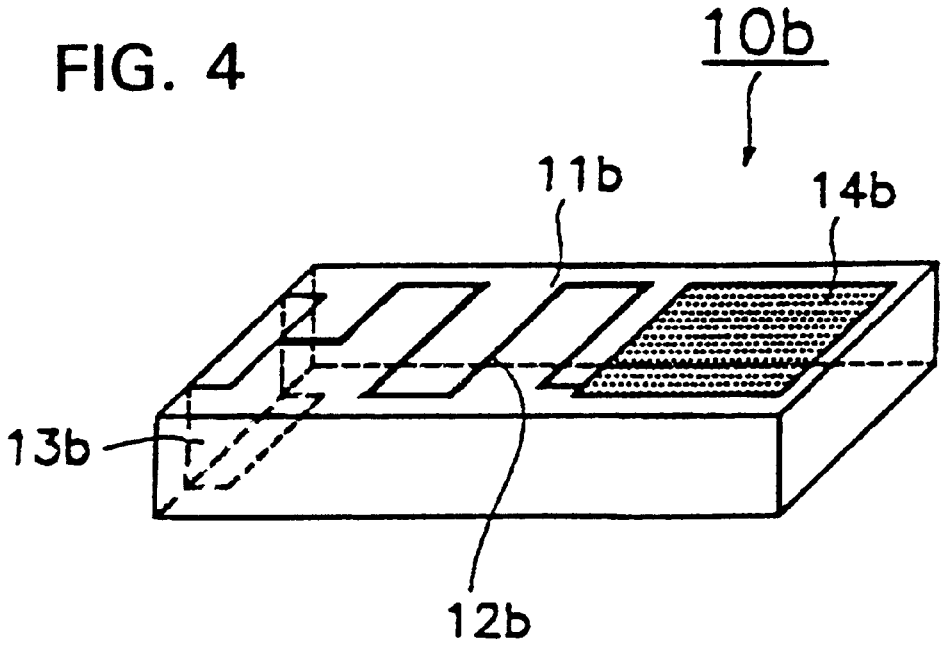
FIG. 4 is a perspective view illustrating another example of modifications made to the chip antenna shown in FIG. 1.

FIGS. 3 and 4 are respectively perspective views illustrating examples of modifications made to the chip antenna shown in FIG. 1. A chip antenna 10*a* shown in FIG. 3 is formed of a rectangular-prism substrate 11*a*, a conductor 12*a*, a power feeding terminal 13*a*, and a trimming electrode 14*a* generally formed in the shape of a rectangle. The conductor 12*a* is spirally wound along the surfaces of the substrate 11 in the longitudinal direction of the substrate 11. The power feeding terminal 13*a* is provided over the surfaces of the substrate 11 in order to apply a voltage to the conductor 12*a* and is connected to one end of the conductor 12*a*. The trimming electrode 14*a* generally formed in a rectangle is provided within the substrate 11 and is connected to the other end of the conductor 12*a*. With the above configuration, a capacitive coupling is formed between the trimming electrode 14*a* and a ground (not shown) of a mobile communication unit on which the chip antenna 10*a* is mounted, and between the trimming electrode 14 and the conductor 12*a*. In this modification, the conductor is easy to spirally form on the surfaces of a substrate by means such as screen printing, thereby simplifying the manufacturing process of the chip antenna.

A chip antenna 10*b* shown in FIG. 4 is formed of a rectangular prism substrate 11*b*, a meandering conductor 12*b* formed on the surface (one main surface) of the substrate 11*b*, a power feeding terminal 13*b*, and a trimming electrode 14*b* formed generally in a rectangle. The power feeding terminal 13*b* is disposed over the surfaces of the substrate 11*b* in order to apply a voltage to the conductor 12*b* and is connected to one end of the conductor 12*b*. The trimming electrode 14*b* is formed on the surface of the substrate 11*b* and is connected to the other end of the conductor 12*b*. With the above configuration, a capacitor element is formed between the trimming electrode 14*b* and a ground (not shown) of a mobile communication unit on which the chip antenna 10*b* is mounted, and between the trimming electrode 14*b* and the conductor 12*b*. In this modification, since a meandering conductor is formed only on one main surface of the substrate, the height of the substrate becomes smaller, thereby decreasing the height of the chip antenna. It should be noted that a meandering conductor may be provided within the substrate.

Figure 5:
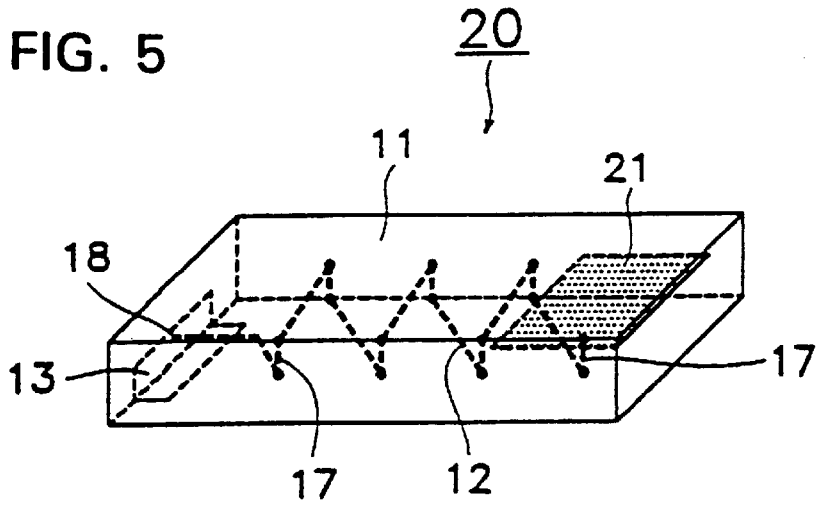
FIG. 5 is a diagram illustrating the relationship between the area of the trimming electrode and the resonant frequency of the chip antenna.

FIG. 5 is a perspective view illustrating a second embodiment of a chip antenna of the present invention. A chip antenna 20 differs from the chip antenna 10 in that a trimming electrode is provided within a substrate. More specifically, the chip antenna 20 is formed of a rectangular prism substrate 11, a conductor 12 spirally wound within the substrate 11 in the longitudinal direction of the substrate 11, a power feeding terminal 13, and a trimming electrode 21 generally formed in a rectangle. The power feeding terminal 13 is provided over surfaces of the substrate 11 in order to apply a voltage to the conductor 12 and is connected to one end of the conductor 12. The trimming electrode 21 is provided within the substrate 11 and is connected to the other end of the conductor 12. With the above construction, a capacitive coupling is formed between the trimming electrode 21 and a ground (not shown) of a mobile communication unit on which the chip antenna 20 is mounted and between the trimming electrode 21 and the conductor 12.

According to the manufacturing method for the trimming electrode 21, in a chip antenna, such as the one shown in FIG. 2, the trimming electrode 21 is formed together with the conductor patterns 16*e* through 16*g* on the surface of the sheet layer 15*b*.

Figure 6:
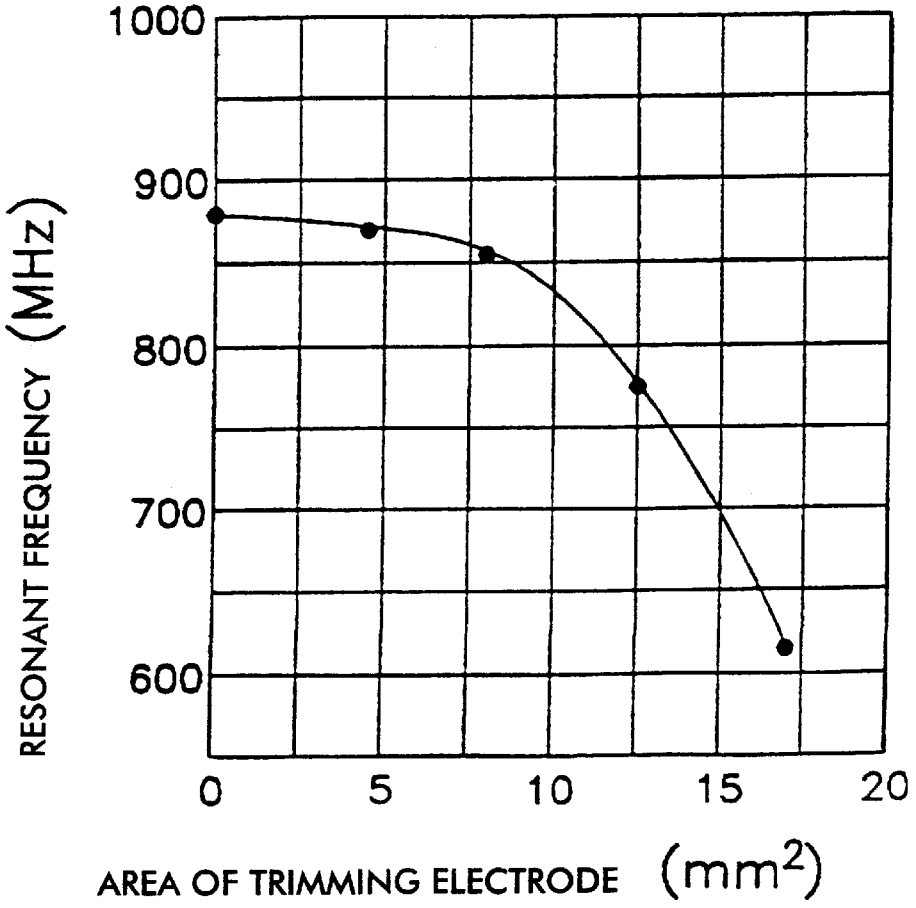
FIG. 6 is a perspective view illustrating a second embodiment of a chip antenna of the present invention.

FIG. 6 illustrates the relationship between the measured area S ($mm^2$) of the trimming electrode and the resonant frequency f (GHz) of the chip antenna. The relative dielectric constant of a dielectric material for the substrate is approximately 6.1.

FIG. 6 reveals that an increase in the area of the trimming electrode decreases the resonant frequency. More specifically, a trimming electrode having an area of about 16.8 ($mm^2$) is formed on a chip antenna having a resonant frequency of about 880 (MHz), thereby reducing the resonant frequency to be approximately 615 (MHz).

Figure 7:
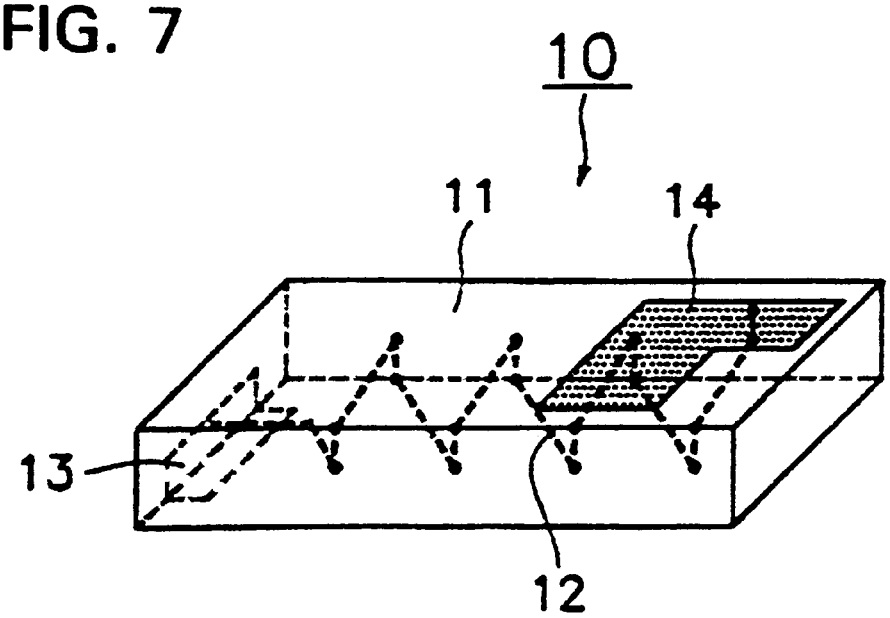
FIG. 7 is a perspective view illustrating the chip antenna shown in FIG. 1 provided with the partially cut trimming electrode.

A method for adjusting the resonant frequency in the manufacturing process for actual products is explained as an example by referring to the chip antenna 10 of the first embodiment. A trimming electrode 14 having a predetermined area is cut by laser, as illustrated in FIG. 7, thereby decreasing the area of the trimming electrode 14 and increasing the resonant frequency of the chip antenna 10.

In a chip antenna, such as the one 20 shown in FIG. 5, the trimming electrode 21 formed within the substrate 11 is cut together with the substrate 11.

The foregoing adjustment for the resonant frequency is explained below by using an equation. When the inductance component of the conductor is indicated by L, and a capacitive coupling generated between the end of the conductor connected to the trimming electrode and a ground of a mobile communication unit on which the chip antenna is mounted is represented by C1, a capacitive coupling generated between the trimming electrode and a ground of the mobile communication unit on which the chip antenna is mounted is designated by C2, and a capacitive coupling generated between the trimming electrode and the conductor is indicated by C3, the resonant frequency f is expressed by the following equation.

Mathematical equation 1:

$$f = \frac{1}{2\pi\sqrt{L(C1 + C2 + C3)}}$$

Consequently, the area of the trimming electrode is decreased to reduce the capacitive couplings C2 and C3, thereby increasing the resonant frequency f.

According to the configuration of each of the chip antennas of the foregoing first and second embodiments, a trimming electrode connected to the other end of the conductor is provided. This makes it possible to form a capacitive coupling between the trimming electrode and a conductor and between the trimming electrode and a ground of a mobile communication unit on which the chip antenna is mounted. Accordingly, by adjusting the area of the trimming electrode, the capacitive coupling of the chip antenna is adjustable, thereby enabling the adjustment of the resonant frequency of the chip antenna. As a consequence, the resonant frequency is easily adjustable in the manufacturing process of the chip antenna, thereby improving the yield of the chip antenna.

Figure 8:
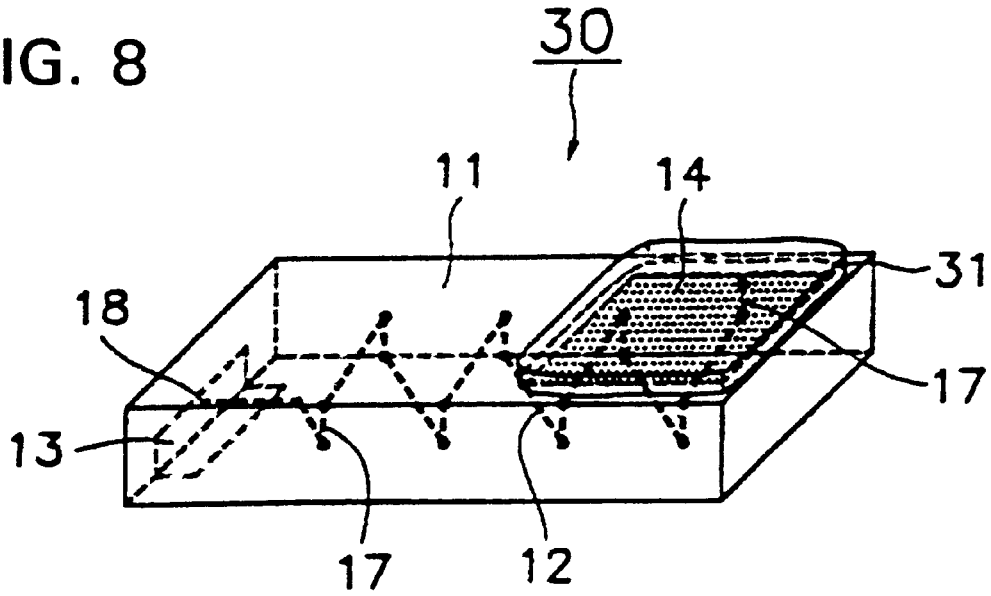
FIG. 8 is a perspective view illustrating a third embodiment of a chip antenna of the present invention.

FIG. 8 is a perspective view illustrating a third embodiment of a chip antenna of the present invention. A chip antenna 30 is different from the chip antenna 10 in that a trimming electrode is coated with a resin layer. More specifically, the chip antenna 30 is formed of a rectangular prism substrate 11, a conductor 12 spirally wound within the substrate 11 in the longitudinal direction of the substrate 11, a power feeding terminal 13, a trimming electrode 14 formed generally in a rectangle, and a resin layer 31 covering the trimming electrode 14. The power feeding terminal 13 is formed over surfaces of the substrate 11 in order to apply a voltage to the conductor 12 and is connected to one end of the conductor 12. The trimming electrode 14 is provided within the substrate 11 and is connected to the other end of the conductor 12.

According to the configuration of the chip antenna of the above-described third embodiment, the trimming electrode is covered with a resin layer, thereby improving environment-resistance characteristics and further enhancing the reliability of the chip antenna.

In the foregoing chip antennas, the substrate of the chip antenna or the substrate of the antenna unit is made of a dielectric material essentially consisting of barium oxide, aluminum oxide, and silica. However, the substrate is not restricted to the above type of dielectric material, and may be made of a dielectric material essentially consisting of titanium oxide and neodymium oxide, a magnetic material essentially consisting of nickel, cobalt and iron, or a combination of a dielectric material and a magnetic material.

Although only one conductor is provided for the foregoing embodiments, a plurality of conductors located in parallel to each other may be provided. In this case, the resulting chip antenna has a plurality of resonant frequencies in accordance with the number of conductors, thereby making it possible to cope with multi bands in one chip antenna or in one antenna unit.

Figure 9A:
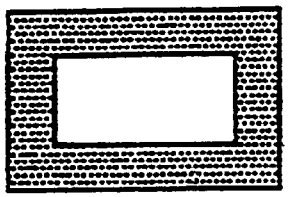
FIGS. 9(*a*) is a top view illustrating an internally hollowed-out shape as an example of a modification made to the trimming electrode.
Figure 9B:
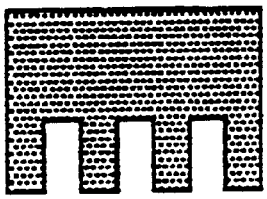
Figure 9C:
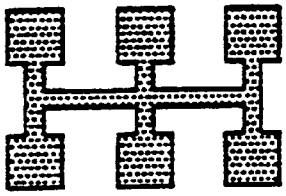
Figure 10:
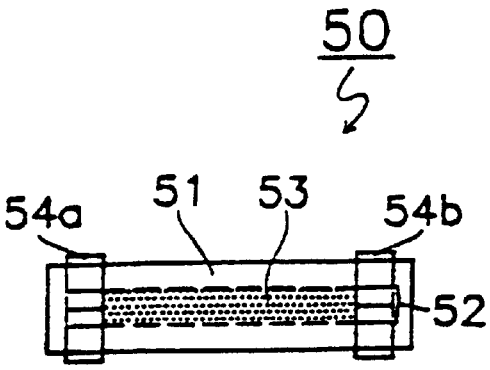
FIG. 10 PRIOR ART
FIG. 10 is a perspective side view illustrating a known chip antenna.

Moreover, although in the foregoing embodiments, the trimming electrode is formed generally in the shape of a rectangle, it may be linear, or formed generally in the shape of a circle, an ellipse, or a polygon. Alternatively, the trimming electrode may be formed in an internally hollowed-out shape, a comb-like shape, or a group-like shape, as shown in FIGS. 9(*a*) through 9(*c*), respectively.

Further, in the foregoing embodiments, the conductor is formed within or on the surface of the substrate. However, a spiral or meandering conductor may be formed both on a surface and within the substrate.

A laser is used to cut the trimming electrode. Additionally, a sandblaster or a toother may be used.

While the invention has been particularly shown and described with reference to preferred embodiments thereof, it will be understood by those skilled man in the art that the forgoing and other changes in form and details may be made therein without departing from the spirit of the invention.

What is claimed is:

1. A chip antenna comprising:

a substrate made of at least one of a dielectric material and a magnetic material;

at least one conductor disposed at least one of within said substrate and on a surface of said substrate;

at least one power feeding terminal disposed on a surface of said substrate and connected to one end of said conductor for applying a voltage to said conductor; and a trimming electrode disposed at least one of within said substrate and on a surface of said substrate and connected to the other end of said conductor; and further wherein the substrate comprises a plurality of layers stacked on top of each other, the stacked layers having a direction normal to the stacked layers, the at least one conductor disposed spirally within the substrate or on the surface of the substrate and having a spiral axis extending perpendicular to the direction normal to the stacked layers.

2. The chip antenna according to claim 1, further comprising a resin layer covering said trimming electrode.

3. The chip antenna according to claim 1, wherein:

said substrate is formed by laminating a plurality of said stacked layers together, the layers each having a major surface; and said trimming electrode is disposed on one of the major surfaces of said layers.

4. A method for adjusting a frequency of a chip antenna, the chip antenna comprising a substrate made of at least one of a dielectric material and a magnetic material; at least one conductor disposed at least one of within said substrate and on a surface of said substrate; at least one power feeding terminal disposed on a surface of said substrate and connected to one end of said conductor for applying a voltage to said conductor; and a trimming electrode disposed at least one of within said substrate and on a surface of said substrate and connected to the other end of said conductor; and further wherein the substrate comprises a plurality of layers stacked on top of each other, the stacked layers having a direction normal to the stacked layers, the at least one conductor disposed spirally within the substrate or on the surface of the substrate and having a spiral axis extending perpendicular to the direction normal to the stacked layers; the method comprising the step of: changing an area of said trimming electrode.

5. The method according to claim 4, wherein: the area of said trimming electrode is changed by using a laser.

* * * * *